US012778327B1

(12) United States Patent
Gupta

(10) Patent No.: US 12,778,327 B1
(45) Date of Patent: Nov. 3, 2026

(54) FITTED SHEET FOR MATTRESS

(71) Applicant: Trident Limited, Barnala (IN)

(72) Inventor: Abhishek Gupta, Ludhiana (IN)

(73) Assignee: Trident Limited, Barnala (IN)

( * ) Notice: Subject to any disclaimer, the term of this patent is extended or adjusted under 35 U.S.C. 154(b) by 0 days.

(21) Appl. No.: 19/326,924

(22) Filed: Sep. 12, 2025

(30) Foreign Application Priority Data

May 19, 2025 (IN) ..... 202511048259

(51) Int. Cl.
*A47G 9/02* (2006.01)
*A47G 9/04* (2006.01)

(52) U.S. Cl.
CPC ..... *A47G 9/0246* (2013.01); *A47G 9/04* (2013.01); *A47G 9/02* (2013.01); *A47G 2009/0269* (2013.01); *Y10S 5/923* (2013.01)

(58) Field of Classification Search
CPC ..... A47G 9/0246; A47G 9/02; A47G 9/0238; A47G 9/04; A47G 9/0223; A47G 9/0253; A47G 9/0261; A47G 9/0292; A47G 9/0207; A47G 9/083; A47G 2009/001; A47G 9/007; A47G 9/023; A47G 9/10; A47G 2009/004; A47G 9/00; A47G 9/0284; A47G 11/004; A47C 21/022; A47C 31/105; A47C 21/028; D04B 1/18; D04B 21/165; D04B 21/18; Y10T 24/23; Y10T 29/481; Y10S 5/923
USPC ..... 5/497, 496, 499, 498, 494, 495
See application file for complete search history.

(56) References Cited

U.S. PATENT DOCUMENTS

| | | | | |
|---|---|---|---|---|
| 9,999,307 | B2 | 6/2018 | Feldman | |
| 2007/0056100 | A1* | 3/2007 | Stewart | A47G 9/0246 5/497 |
| 2014/0109315 | A1* | 4/2014 | Lilienthal | A47G 9/0246 5/497 |
| 2019/0090665 | A1 | 3/2019 | Tak et al. | |
| 2019/0365122 | A1* | 12/2019 | Gupta | A47G 9/0246 |
| 2024/0008662 | A1 | 1/2024 | Goenka et al. | |

* cited by examiner

*Primary Examiner* — Justin C Mikowski
*Assistant Examiner* — Deborah Talitha Gedeon
(74) *Attorney, Agent, or Firm* — The Webb Law Firm

(57) ABSTRACT

A fitted sheet that can be used for mattresses of varying thicknesses, and which reduces or eliminates bunching and wrinkling of the sheet fabric at corners of the mattress. The invention includes a fitted sheet configured for encasing a mattress, including a top panel portion and a plurality of side panel portions. Each of the plurality of side panel portions includes a respective side panel portion bottom surface that is configured to conform to a bottom surface of an encased mattress body, an elastic retainer band that is affixed to each of the side panel portion bottom surfaces, and a resilient tightening member affixed at each junction of the top panel portion and two adjoining side panel portions, wherein the resilient tightening member includes a first resilient vertical member.

17 Claims, 8 Drawing Sheets

FITTED SHEET FOR MATTRESS

CROSS-REFERENCE TO RELATED APPLICATION

This application claims priority to Indian Patent Application No. 202511048259 filed May 19, 2025, the disclosure of which is hereby incorporated by reference in its entirety.

BACKGROUND OF THE INVENTION

Field of the Invention

The present invention is directed towards a sheet for a mattress. In particular, the invention provides a fitted sheet that can be used for mattresses of varying thicknesses, and which reduces or eliminates bunching and wrinkling of the sheet fabric at corners of the mattress.

Description of Related Art

Fitted sheets are designed to function as easy to fit and change coverings for a mattress—and further to conform closely to a mattress body, in a manner conforms that reduces or eliminates unintended movement of the fitted sheet relative to the mattress body.

A fitted sheet comprises a fabric or textile casing that is sized to accommodate a mattress body therewith—and is typically formed such that when enveloping a mattress body, the fitted sheet comprises a top panel portion to conform to a top surface of the mattress, and side panel portions conforming to one or more side surfaces of the mattress (in typical embodiments, a fitted sheet includes four side panel portions, each corresponding to a respective mattress side surface). Each side panel portion of the fitted sheet may be sized so at to be larger than the corresponding side surface of a mattress for which the fitted sheet is sized—such that a portion of each side panel conforms to (and can be positioned beneath) a bottom surface of the mattress. In a typical fitted sheet having four side panel portions, a part of each side panel portion conforms to a bottom surface of the mattress. The respective four bottom surface conforming parts of the four side panels portions are provided with an elastic retainer band (comprising a single elastic band or a series of interconnected elastic bands). The fabric for the fitted sheet is cut in a specific manner to form the shape of fitted sheet. The cut edges are then stitched together to create a depth that corresponds to the intended height of a mattress to which the fitted sheet will be fitted. These stitches are located at the corners of the fitted sheet. The elastic retainer band is subsequently attached at these corners to ensure that the fitted sheet fits securely to or is held securely to the mattress.

The four bottom surface conforming parts of the four side panels and the elastic retainer band form an opening in the fabric casing which can be used for the purposes of fitting the fitted sheet onto a mattress. Once the fitted sheet has been fitted onto a mattress, the elastic action of the elastic retainer band resiliently draws the four bottom surface conforming parts of the four side panel portions towards each other—thereby causing the top panel portion and the side panel portions of the fitted sheet to conform to the mattress body.

It has however been found that despite the action of the elastic retainer band, the fitted sheet fabric conforms poorly to the mattress body at corners of the mattress—resulting in fabric wrinkles (which are aesthetically unpleasing), a less than optimum fit, and unintended movement of the fitted sheet relative to the mattress body.

FIG. 1 illustrates a fitted sheet 100 of a kind known in the prior art, wherein fabric wrinkles can be observed at each of the corners 102*a* to 102*g*.

The problem of undesired fabric wrinkles at corners is even greater where the fitted sheet is intended to be fitted across a range of mattress thicknesses. While the fabric wrinkles are observed to a somewhat lesser degree when the sheet is fitted onto a mattress body having a thickness that is closer to the upper range of the permissible mattress thicknesses to which the sheet can be applied, the problem becomes progressively pronounced as the thickness of the mattress body moves further away from the upper range of the permissible mattress thicknesses to which the sheet can be applied.

There is accordingly a need for a fitted sheet that is capable of being applied to mattress bodies of varying thickness, while simultaneously reducing or eliminating bunching and wrinkling of the sheet fabric at corners of the mattress.

SUMMARY OF THE INVENTION

The present invention is directed towards a sheet for a mattress. In particular, the invention provides a fitted sheet that can be used for mattresses of varying thicknesses, and which reduces or eliminates bunching and wrinkling of the sheet fabric at corners of the mattress.

In an embodiment the invention comprises a fitted sheet configured for encasing a mattress, comprising (i) a top panel portion and a plurality of side panel portions, the top panel portion and the plurality of side panel portions defining an encasement sized to encase a mattress body—wherein each of the plurality of side panel portions includes a respective side panel portion bottom surface that is configured to conform to a bottom surface of an encased mattress body, wherein each of the side panel portion bottom surfaces is resiliently urged towards the other side panel bottom portion bottom surface(s) by an elastic retainer band that is affixed to each of the side panel portion bottom surfaces at or adjacent to a corresponding periphery of said side panel portion bottom surface, and (ii) a resilient tightening member affixed at each junction of the top panel portion and two adjoining side panel portions, wherein (a) the resilient tightening member comprises a first resilient vertical member and a second resilient horizontal member that intersect each other, (b) the first resilient vertical member comprises a first end and an opposed second end, wherein the first end is position at the junction of the top panel portion and the two adjacent side panel portions, and the opposed second end is separated from corresponding side panel bottom surfaces of the conforming parts of two adjacent side panel portions, and (c) the second resilient horizontal member is positioned at a point along a line between the first end and the opposed second end of the resilient vertical member, and comprises two ends, each positioned on opposite sides of the first resilient vertical member.

Further, a sum of a first force vector, a second force vector and a third force vector exerted at an intersection of the first resilient vertical member and the second resilient horizontal member is between 3.2 N (Newton) and 4 N and (i) the first force vector comprises a force vector arising from a first elastic force exerted by the first resilient vertical member, (ii) the second force vector comprises a force vector arising from a second elastic force exerted by the second resilient horizontal member, and (iii) the third force vector comprises a force vector arising from a perpendicular component of a tangential force exerted by the elastic retainer band 204 at a point closest to the intersection of the first resilient vertical member and the second resilient horizontal member.

In another embodiment, the invention provides a fitted sheet configured to encase a mattress, the fitted sheet comprising (i) a top panel portion, and (ii) a plurality of side panel portions adjoining the top panel portion, wherein the top panel portion and the plurality of side panel portions together form an enclosure configured to receive and conform to the contours of a mattress body—wherein each side panel portion comprises a bottom edge adapted to be drawn under the mattress and resiliently secured by an elastic retainer band affixed along the periphery of said bottom edge.

At each junction of the top panel portion and two adjacent side panel portions, a resilient tightening member is affixed, the resilient tightening member comprising: (i) a first vertically oriented elastic strip having a first end positioned at said junction and a second end spaced from the bottom edge; and (ii) a second horizontally oriented elastic strip intersecting said vertically oriented elastic strip between its first and second ends, the second horizontally oriented elastic strip extending laterally across the side panel portions.

The intersection of the vertically and horizontally oriented elastic strips is configured to exert a cumulative force defined by a first vertical force vector, a second horizontal force vector, and a third tangential force vector generated by the elastic retainer band, such that the resultant force at the intersection falls within a range of approximately 3.2 N to 4.0 N.

Additionally (i) the first force vector is generated by elongation of the vertically oriented elastic strip, (ii) the second force vector is generated by elongation of the horizontally oriented elastic strip, and (iii) the third force vector is generated by tangential contraction of the elastic retainer band.

BRIEF DESCRIPTION OF THE DRAWINGS

The terms Fig., Figs., Figure, and Figures are used interchangeably in the specification to refer to the corresponding figures in the drawings.

DESCRIPTION OF THE INVENTION

The present invention is directed towards a sheet for a mattress. In particular, the invention provides a fitted sheet that can be used for mattresses of varying thicknesses, and which reduces or eliminates bunching and wrinkling of the sheet fabric at corners of the mattress.

Figure 1:
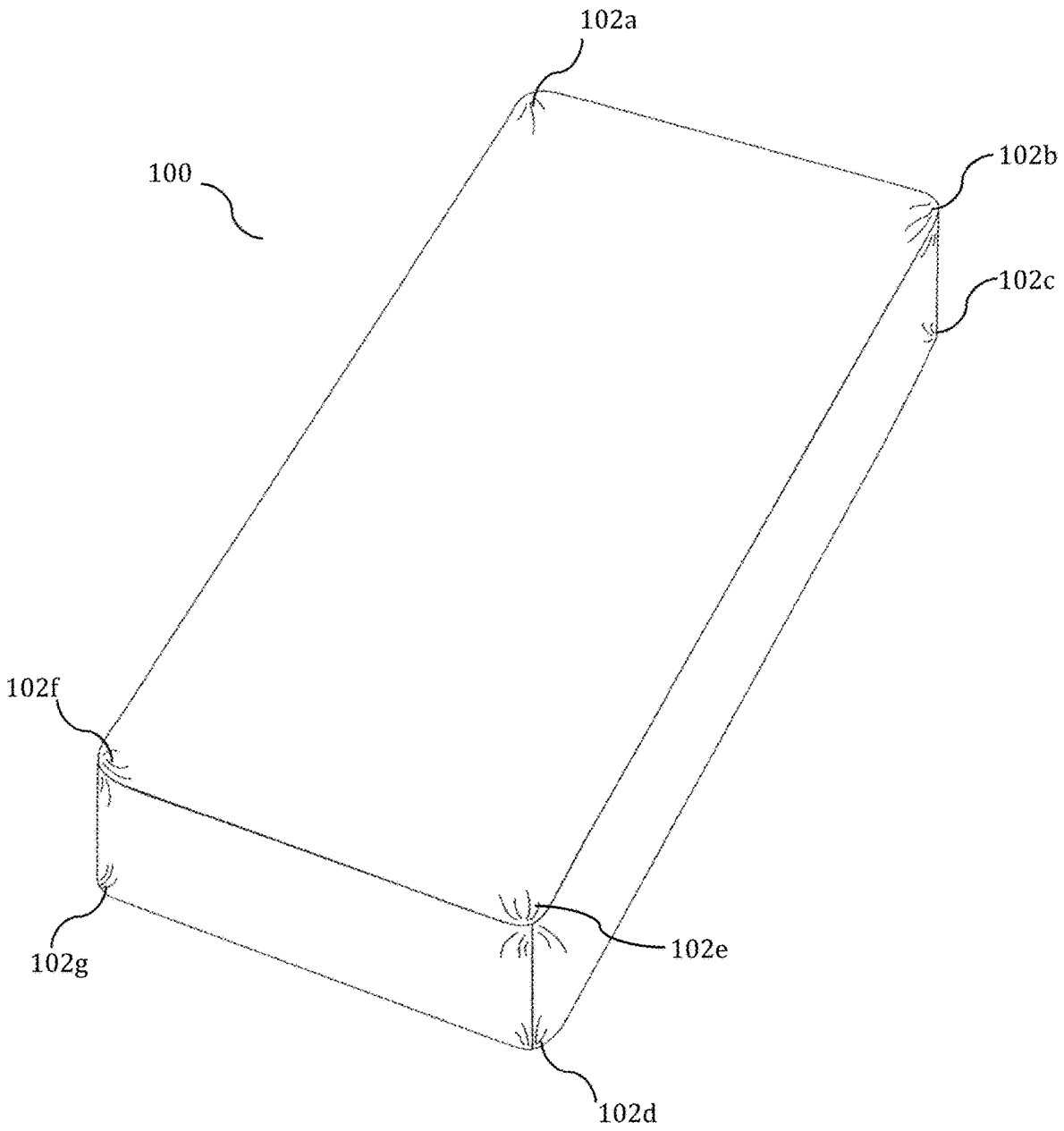
FIG. 1 illustrates a fitted sheet of a kind existing in the state of art.
Figure 2A:
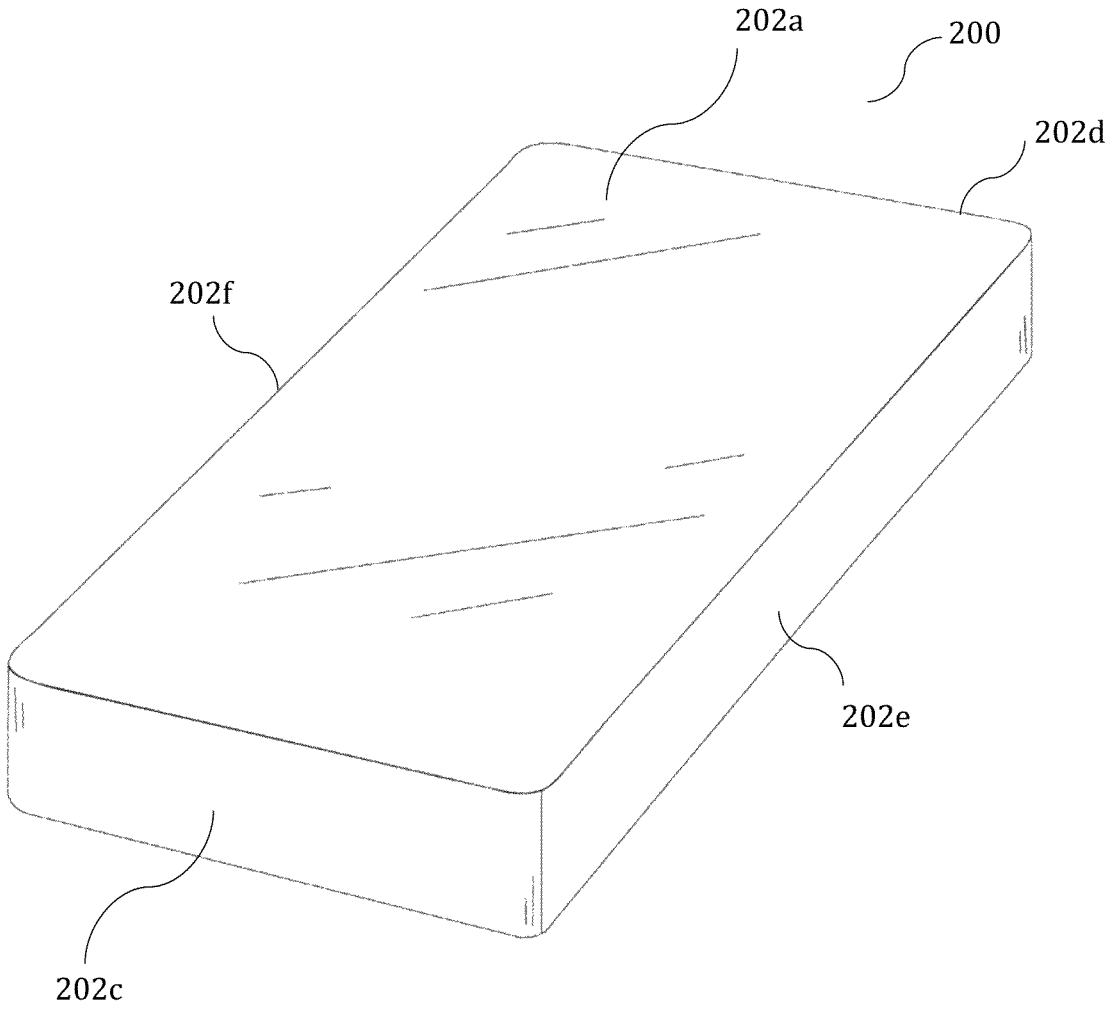
FIGS. 2*a* and 2*b* illustrate components of a fitted sheet.
Figure 2B:
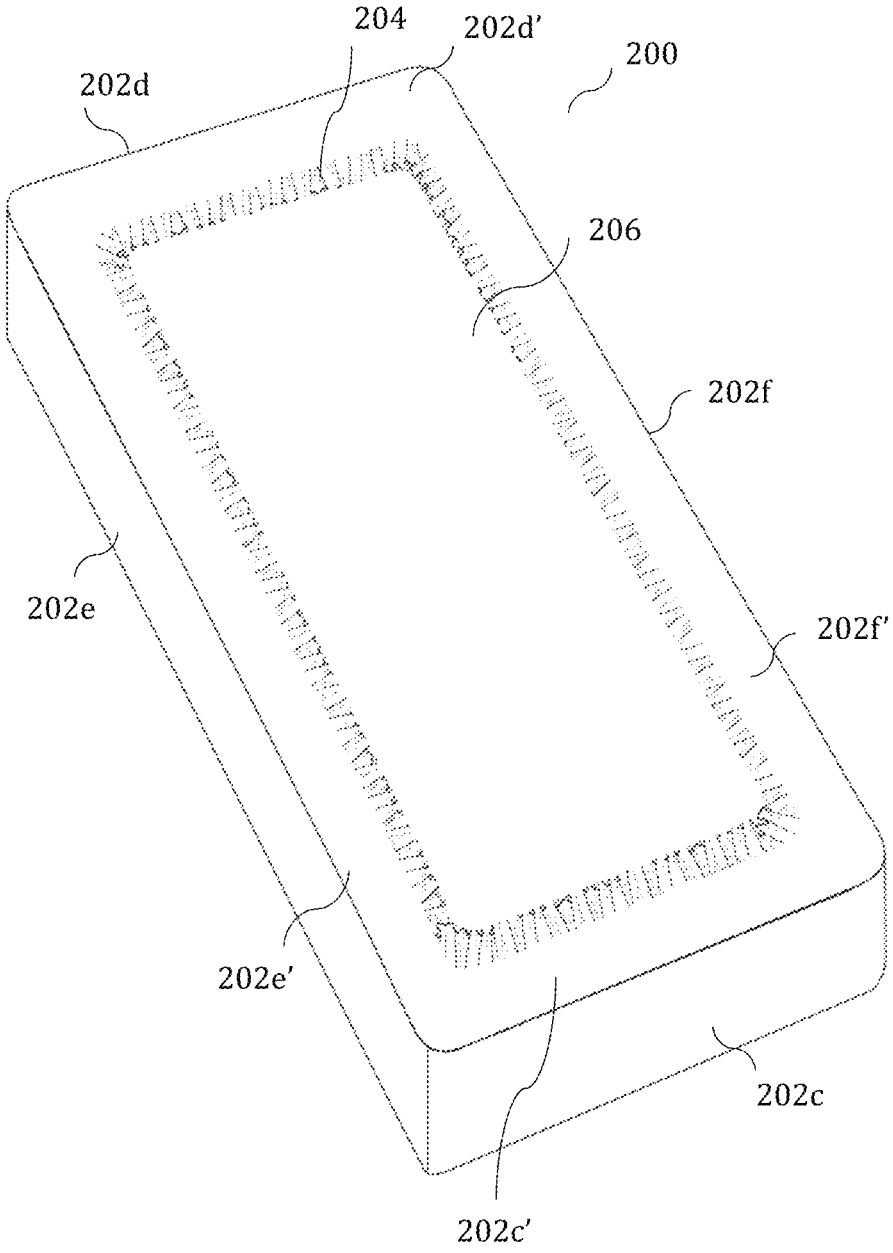

FIGS. 2*a* and 2*b* illustrate components of a fitted sheet 200 that has been fitted onto (i.e. that has been used to encase) a mattress body.

Fitted sheet 200 comprises a fabric or textile casing that is sized to accommodate a mattress body therewithin—and is typically formed such that when enveloping a mattress body, the fitted sheet 200 comprises a top panel portion 202*a* to conform to a top surface of the mattress, and side panel portions 202*c*, 202*d*, 202*e*, 202*f* that conform to respective side surfaces of the mattress. Each side panel portion 202*c*, 202*d*, 202*e*, 202*f* of the fitted sheet 200 is sized so at to be larger than the corresponding side surface of a mattress for which the fitted sheet 200 is sized—such that a corresponding portion 202*c*', 202*d*', 202*e*', 202*f*' of each side panel 202*c*, 202*d*, 202*e*, 202*f* conforms to (and can be positioned beneath) a bottom surface 206 of the mattress.

In the illustrated fitted sheet 200, the respective four bottom surface conforming parts 202*c*', 202*d*', 202*e*', 202*f*' of the four side panels portions 202*c*, 202*d*, 202*e*, 202*f* are provided with an elastic retainer band 204 (comprising a single elastic band or a series of interconnected elastic bands). The fabric for the fitted sheet 200 is cut in a specific manner to form the shape of fitted sheet 200. The cut edges are then stitched together to create a depth that corresponds to the intended height of a mattress to which the fitted sheet 200 will be fitted. These stitches are located at the corners of the fitted sheet 200. The elastic retainer band 204 is subsequently attached at these corners to ensure that the fitted sheet 200 fits securely to or is held securely to the mattress.

Elastic retainer band 204 may comprise a single elastic band, or a series of interconnected elastic bands. In an embodiment of the invention, elastic retainer band 204 comprises a woven or knitted elastic that is stitched or otherwise affixed to the fitted sheet fabric. In a specific embodiment, elastic retainer band 204 comprises an elastic retainer band having 25 mm thickness. In another embodiment, the elastic retainer band 204 is affixed to fitted sheet 200 using a double-stitch stitching pattern.

The four bottom surface conforming parts 202*c*', 202*d*', 202*e*', 202*f*' of the four side panels portions 202*c*, 202*d*, 202*e*, 202*f* and the elastic retainer band 204 form an opening in the fabric casing which can be used for the purposes of fitting the fitted sheet 200 onto a mattress. Once the fitted sheet 200 has been fitted onto a mattress, the elastic action of the elastic retainer band 204 resiliently draws the four bottom surface conforming parts 202*c*',202*d*', 202*e*', 202*f*' of the four side panels portions 202*c*, 202*d*, 202*e*,202*f* towards each other—thereby causing the top panel portion 202*a* and the side panel portions 202*c*, 202*d*, 202*e*, 202*f* of the fitted sheet 200 to conform closely to the mattress body.

It will be understood that the top panel portion 202*a* and the side panel portions 202*c*, 202*d*, 202*e*, 202*f* may comprise a single contiguous or integrated fabric piece, or alternatively may be formed from a plurality of fabric pieces or fabric segments that are affixed together.

Figure 3A:
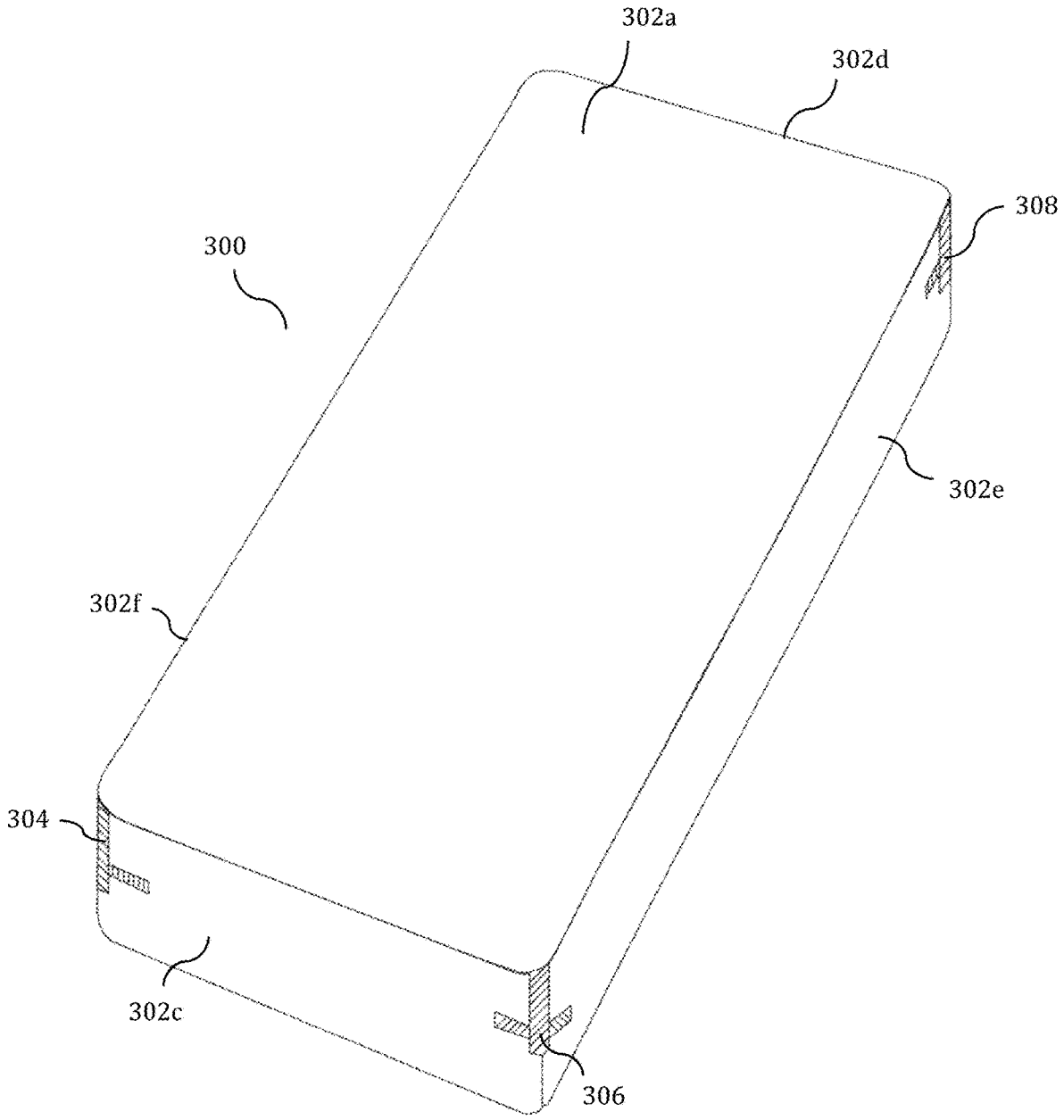
FIGS. 3*a* and 3*b* illustrate a fitted sheet in accordance with the teaching of the present invention having one or more resilient tightening members provided at the junction of adjoining side panel portions.
Figure 3B:
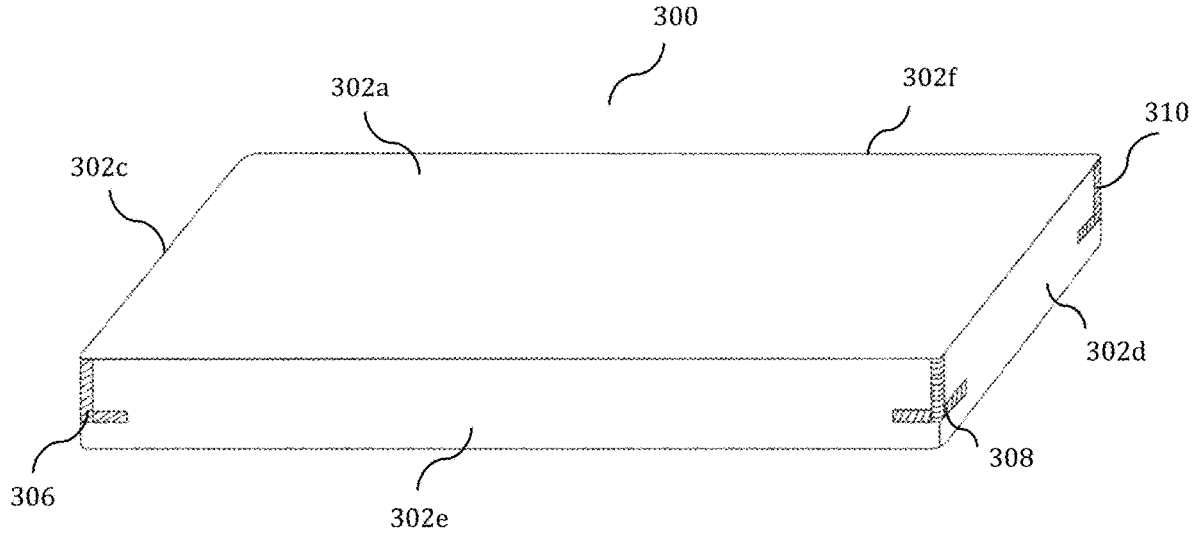

FIGS. 3*a* and 3*b* illustrate a fitted sheet 300 in accordance with the teaching of the present invention.

Fitted sheet 300 as illustrated comprises a fabric or textile casing that is sized to accommodate a mattress body therewithin—and is formed such that when enveloping a mattress body, the fitted sheet 300 comprises a top panel portion 302*a* to conform to a top surface of the mattress, and side panel portions 302*c*, 302*d*, 302*e*, 302*f* that conform to respective side surfaces of the mattress. Each side panel portion 302*c*, 302*d*, 302*e*, 302*f* of the fitted sheet 300 is sized so at to be larger than the corresponding side surface of a mattress for which the fitted sheet 300 is sized—such that a corresponding portion (not shown) of each side panel 302*c*, 302*d*, 302*e*, 302*f* conforms to (and can be positioned beneath) a bottom surface of the mattress.

As in the case of FIGS. 2*a* and 2*b*, the respective four bottom surface conforming parts of the four side panels portions 302*c*, 302*d*, 302*e*, 302*f* of fitted sheet 300 are provided with an elastic retainer band (not shown) that comprises a single elastic band or a series of interconnected elastic bands). The fabric for the fitted sheet 300 is cut in a specific manner to form the shape of fitted sheet 300. The cut edges are then stitched together to create a depth that corresponds to the intended height of a mattress to which the fitted sheet 300 will be fitted. These stitches are located at the corners of the fitted sheet 300. The elastic retainer band is subsequently attached at these corners to ensure that the fitted sheet 300 fits securely to or is held securely to the mattress.

The elastic retainer band may comprise a single elastic band, or a series of interconnected elastic bands. In an embodiment of the invention, elastic retainer band 204 comprises a woven or knitted elastic that is stitched or otherwise affixed to the fitted sheet fabric. In a specific embodiment, the elastic retainer band comprises an elastic retainer band having 25 mm thickness. In another embodiment, the elastic retainer band is affixed to fitted sheet 300 using a double-stitch stitching pattern.

The four bottom surface conforming parts of the four side panels portions 302*c*, 302*d*, 302*e*, 302*f* and the elastic retainer band form an opening in the fabric casing which can be used for the purposes of fitting the fitted sheet 300 onto a mattress. Once the fitted sheet 300 has been fitted onto a mattress, the elastic action of the elastic retainer band resiliently draws the four bottom surface conforming parts 202*f'* of the four side panels portions 302*c*, 302*d*, 302*e*, 302*f* towards each other—thereby causing the top panel portion 302*a* and the side panel portions 302*c*, 302*d*, 302*e*, 302*f* of the fitted sheet 200 to conform closely to the mattress body.

The top panel portion 302*a* and the side panel portions 302*c*, 302*d*, 302*e*, 302*f* may comprise a single contiguous or integrated fabric piece, or alternatively may be formed from a plurality of fabric pieces or fabric segments that are affixed together.

As shown in FIGS. 3*a* and 3*b*, fitted sheet 300 includes one or more resilient tightening members 304, 306, 308, 310, wherein each resilient tightening member 304, 306, 308, 310 is provided at a junction of adjoining side panel portions 302*c*, 302*d*, 302*e*, 302*f* of fitted sheet 300. In an embodiment of the invention, fitted sheet 300 may include a resilient tightening member 304, 306, 308, 310 at a junction of each pair of adjoining panel portions of the fitted sheet 300.

Each resilient tightening member 304, 306, 308, 310 comprises a resilient vertical member and a resilient horizontal member that are affixed to each other at an angle of substantially ninety degrees (90°).

Figure 4A:
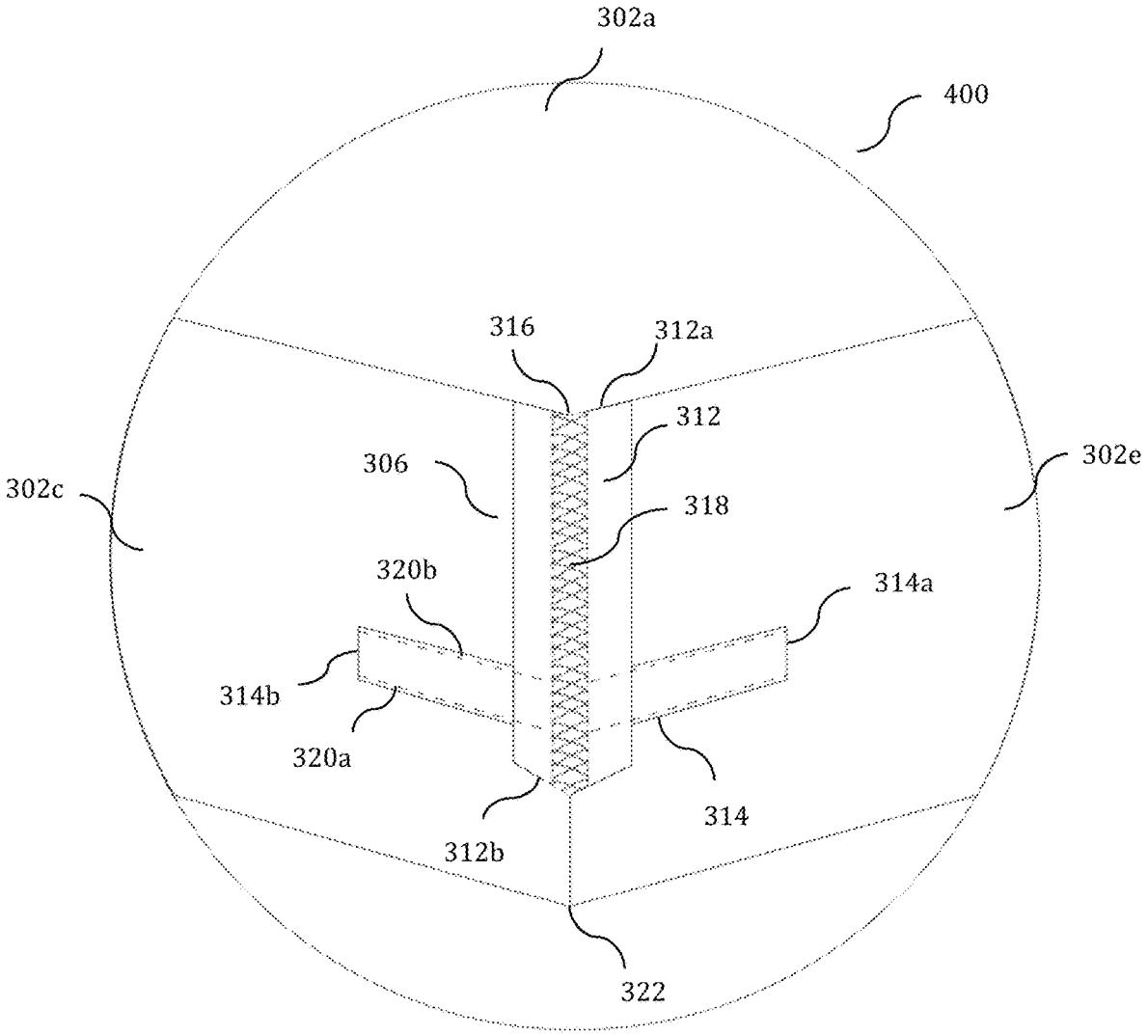
FIG. 4*a* shows a magnified view of an embodiment of a resilient tightening member of the kind illustrated in FIG. 3.

FIG. 4*a* shows a magnified view 400 of an embodiment of a resilient tightening member 306. It will however be understood that a resilient tightening member having the same or similar configuration can be used for any one or more of resilient tightening member 304, 306, 308, 310.

As shown in magnified view 400, resilient tightening member 306 comprises a resilient vertical member 312 and a resilient horizontal member 314. The resilient vertical member 312 is a first vertically oriented elastic strip, and the resilient horizontal member 314 is a second horizontally oriented elastic strip.

The first resilient vertical member 312 of resilient tightening member 306 is positioned at a junction of two adjoining side panel portions 302*c*, 302*f* of the fitted sheet 300 such that (i) a first end 312*a* of the first vertically oriented elastic strip 312 is positioned at or substantially at a junction of top panel portion 302*a* and two adjoining side panel portions 302*c*, 302*e* of the fitted sheet 300 and (ii) an opposed second end 312*b* of the first vertically oriented elastic strip 312 is positioned at the junction of said two adjoining side panel portions 302*c*, 302*e* of the fitted sheet 300 at a point that is intermediate between (a) the junction of top panel portion 302*a* and the two adjoining side panel portions 302*c*, 302*e* of the fitted sheet 300 and (b) the junction of said two adjoining side panel portions 302*c*, 302*e* and their respective bottom surface conforming parts.

Stated differently the first vertically oriented elastic strip 312 is configured and positioned on fitted sheet 300 such that, a first end 312*a* of said first vertically oriented elastic strip 312 is coincident with a top corner 316 (formed at a junction of top panel portion 302*a* and two adjoining side panel portions 302*c*, 302*e*) of the fitted sheet 300, whereas the second end 312*b* of said first vertically oriented elastic strip 312 does not extend to (and is separated from) a bottom corner 322 (formed at the corresponding bottom surface conforming parts of two adjoining side panel portions 302*c*, 302*d*, 302*e*, 302*f*) of the fitted sheet 300.

In an embodiment, when the fitted sheet 300 is fitted onto a mattress, a first end 312*a* of said first vertically oriented elastic strip 312 is coincident with a top corner of the mattress, whereas the second end 312*b* of said first vertically oriented elastic strip 312 does not extend to (and is separated from) the corresponding bottom corner of a mattress that is encased within the fitted sheet. In an embodiment, the first vertically oriented elastic strip 312 comprises an elastic strip having between 10 mm and 14 mm thickness. In an embodiment, the first vertically oriented elastic strip 312 comprises an elastic strip having between 0.39 inches and 0.56 inches thickness. In another embodiment, the first vertically oriented elastic strip 312 comprises an elastic strip having 12 mm (0.472 inch) thickness. In another embodiment, the first vertically oriented elastic strip 312 comprises an elastic strip having between 1:1.5 and 1:3 elongation. In another embodiment, the first vertically oriented elastic strip 312 is affixed to the fitted sheet 300 using a single-stitch stitching pattern or a double-stitch stitching pattern or an overlock-stitch stitching pattern.

In an embodiment, the opposed second end 312*b* of the first vertically oriented elastic strip 312 is affixed to the fitted sheet 300 at a distance of between 100 mm and 305 mm from the elastic retainer band provided on fitted sheet 300. In another embodiment, the opposed second end 312*b* of the first vertically oriented elastic strip 312 is affixed to the fitted sheet 300 at a distance of between 4 inches and 14 inches from the elastic retainer band. In an embodiment of the invention, the opposed second end 312*b* of the first vertically oriented elastic strip 312 is separated from the elastic retainer band by a distance of substantially 154.2 mm.

In Table 1 below, various non-limiting, exemplary extension and force parameters corresponding to exemplary embodiments of the first vertically oriented elastic strip 312 are provided.

| Exemplary Specimen | Extension (%) | Force (N/Newton) |
|---|---|---|
| Specimen # 1 | 100% | 5.1 |
| Specimen # 2 | 200% | 11.34 |
| Specimen # 3 | 225% | 77.22 |

In an embodiment, the second resilient horizontal member 314 of resilient tightening member 306 is affixed horizontally across a junction of two adjoining side panel portions 302*c*, 302*e* of fitted sheet 300 such that (i) the second resilient horizontal member 314 of resilient tightening member 306 intersects the corresponding first resilient vertical member 312 of said resilient tightening member 306, and (ii) is positioned at (a) a point between the first end 312*a* and the opposed second end 312*b* of the first vertically oriented elastic strip 312 or (b) at the opposed second end 312*b* of the first vertically oriented elastic strip 312. The second resilient horizontal member 314 of resilient tightening member 306 comprises a first end 314*a* and an opposed second end 314*b*, wherein said first end 314*a* and said opposed second end 314*b* are respectively positioned on opposite sides of the first resilient vertical member 312 of resilient tightening member 306.

In the embodiment shown in FIG. 4*a*, first resilient vertical member 312 of resilient tightening member 306 may be affixed to fitted sheet 300 by an overlock-stitch stitching 308 (or alternatively by any other stitching pattern, including any of a single-stitch stitching pattern or a double-stitch stitching pattern), whereas second resilient horizontal member 314 of resilient tightening member 306 may be affixed to fitted sheet 300 by a double-stitch stitching 320*a*, 320*b* (or alternatively by any other stitching pattern, including any of a single-stitch stitching pattern or an overlock-stitch stitching pattern).

In an embodiment where the second resilient horizontal member 314 of resilient tightening member 306 is positioned at a point between the first end 312*a* and the opposed second end 312*b* of the first vertically oriented elastic strip 312, the resilient tightening member 306 has a cruciform shape or cruciform configuration (which is shown in FIG. 4*a*).

Figure 4B:
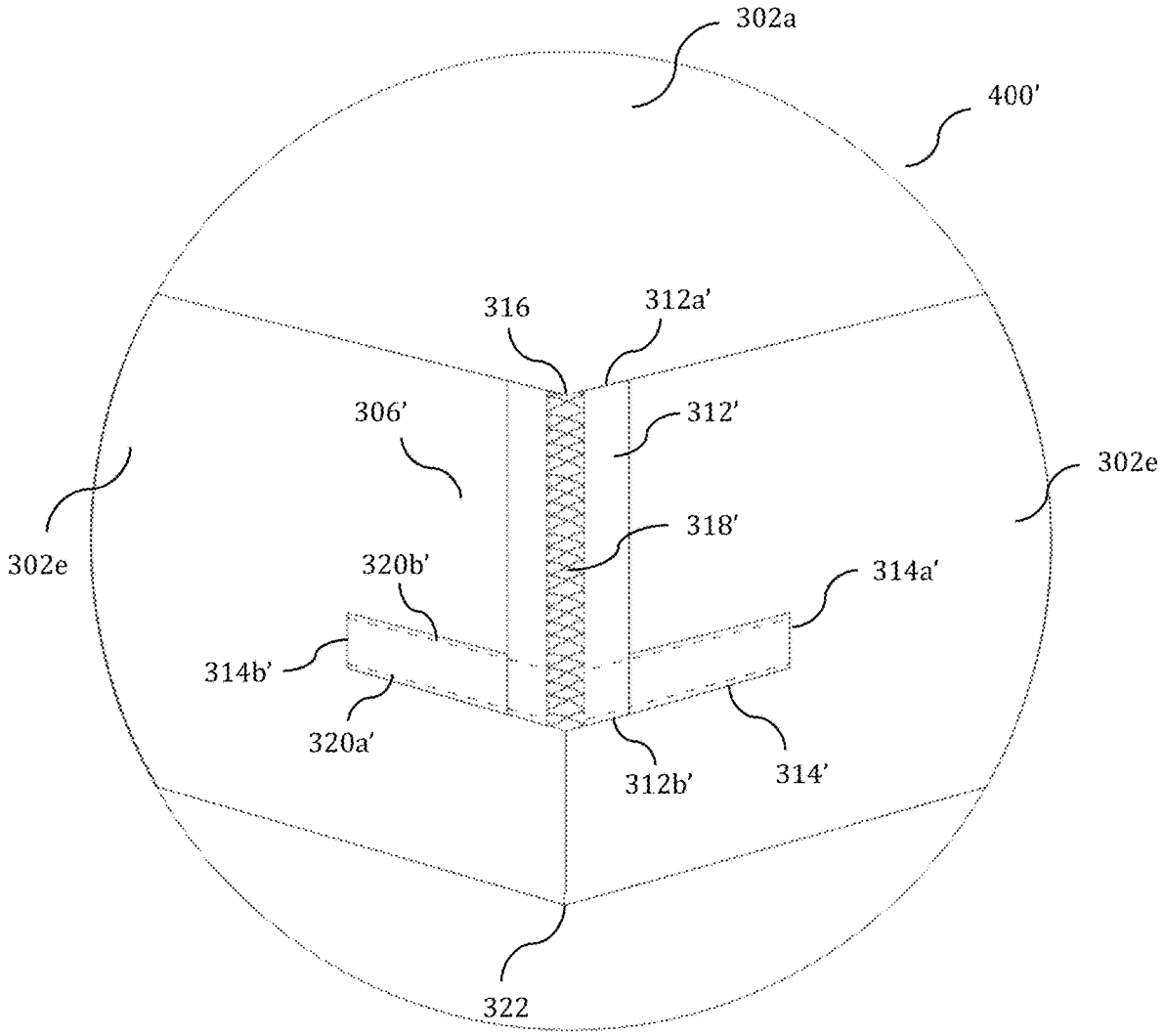
FIG. 4*b* shows a magnified view of another embodiment of a resilient tightening member of the kind illustrated in FIG. 3.

In an alternative embodiment where the second resilient horizontal member 314 of resilient tightening member 306 is positioned at the opposed second end 312*b* of the first vertically oriented elastic strip 312, the resilient tightening member 306 has an inverted T-shape or inverted T-configuration. FIG. 4*b* (discussed below) shows an embodiment of a resilient tightening member of the kind described herein, wherein said resilient tightening member has an inverted T-shape or inverted T-configuration.

FIG. 4*b* shows a magnified view 400' of an embodiment of a resilient tightening member 306' of the kind described herein, wherein said resilient tightening member 306' has an inverted T-shape or an inverted T-shaped configuration. It will be understood that a resilient tightening member 306' having the same or similar configuration can be used for any one or more of resilient tightening member 304, 306, 308, 310.

As shown in magnified view 400', resilient tightening member 306' comprises a resilient vertical member 312' and a resilient horizontal member 314'. The resilient vertical member 312' is a first vertically oriented elastic strip, and the resilient horizontal member 314' is a second horizontally oriented elastic strip.

The first resilient vertical member 312' of resilient tightening member 306' is positioned at a junction of two adjoining side panel portions 302*c*, 302*e* of the fitted sheet 300 such that (i) a first end 312*a*' of the first vertically oriented elastic strip 312' is positioned at or substantially at a junction of top panel portion 302*a* and two adjoining side panel portions 302*c*, 302*e* of the fitted sheet 300 and (i) an opposed second end 312*b*' of the first vertically oriented elastic strip 312' is positioned at the junction of said two adjoining side panel portions 302*c*, 302*e* of the fitted sheet 300 at a point that is intermediate between (a) the junction of top panel portion 302*a* and the two adjoining side panel portions 302*c*, 302*e* of the fitted sheet 300 and (b) the junction of said two adjoining side panel portions 302*c*, 302*e* and their respective bottom surface conforming parts.

Stated differently the first vertically oriented elastic strip 312' is configured and positioned on fitted sheet 300 such that, a first end 312*a*' of said first vertically oriented elastic strip 312' is coincident with a top corner 316 (formed at a junction of top panel portion 302*a* and two adjoining side panel portions 302*c*, 302*e*) of the fitted sheet 300, whereas the second end 312*b*' of said first vertically oriented elastic strip 312 does not extend to (and is separated from) a bottom corner 322 (formed at the corresponding bottom surface conforming parts of two adjoining side panel portions 302*c*, 302*d*, 302*e*, 302*f*) of the fitted sheet 300.

In an embodiment, when the fitted sheet 300 is fitted onto a mattress, a first end 312*a*' of said first vertically oriented elastic strip 312' is coincident with a top corner of the mattress, whereas the second end 312*b*' of said first vertically oriented elastic strip 312' does not extend to (and is separated from) the corresponding bottom corner of a mattress that is encased within the fitted sheet. In an embodiment, the first vertically oriented elastic strip 312' comprises an elastic strip having between 10 mm and 14 mm thickness. In an embodiment, the first vertically oriented elastic strip 312' comprises an elastic strip having between 0.39 inches and 0.56 inches thickness. In another embodiment, the first vertically oriented elastic strip 312' comprises an elastic strip having 12 mm (0.472 inch) thickness. In another embodiment, the first vertically oriented elastic strip 312' comprises an elastic strip having between 1:1.5 and 1:3 elongation. In another embodiment, the first vertically oriented elastic strip 312' is affixed to the fitted sheet 300 using a single-stitch stitching pattern or a double-stitch stitching pattern or an overlock-stitch stitching pattern.

In an embodiment, the opposed second end 312*b*' of the first vertically oriented elastic strip 312' is affixed to the fitted sheet 300 at a distance of between 100 mm and 305 mm from the elastic retainer band provided on fitted sheet 300. In another embodiment, the opposed second end 312*b*' of the first vertically oriented elastic strip 312' is affixed to the fitted sheet 300 at a distance of between 4 inches and 14 inches from the elastic retainer band. In an embodiment of the invention, the opposed second end 312*b*' of the first vertically oriented elastic strip 312' is separated from the elastic retainer band by a distance of substantially 154.2 mm.

In Table 1 below, various non-limiting, exemplary extension and force parameters corresponding to exemplary embodiments of the first vertically oriented elastic strip 312' are provided.

| Exemplary Specimen | Extension (%) | Force (N/Newton) |
|---|---|---|
| Specimen # 1 | 100% | 5.1 |
| Specimen # 2 | 200% | 11.34 |
| Specimen # 3 | 225% | 77.22 |

In the embodiment shown in FIG. 4*b*, the second resilient horizontal member 314' of resilient tightening member 306' is affixed horizontally across a junction of two adjoining side panel portions 302*c*, 302*e* of fitted sheet 300 such that (i) the second resilient horizontal member 314' of resilient tightening member 306' intersects the corresponding first resilient vertical member 312' of said resilient tightening member 306, and (ii) is positioned at (a) a point between the first end 312*a'* and the opposed second end 312*b'* of the first vertically oriented elastic strip 312' or (b) at the opposed second end 312*b'* of the first vertically oriented elastic strip 312'. The second resilient horizontal member 314' of resilient tightening member 306' comprises a first end 314*a'* and an opposed second end 314*b'*, wherein said first end 314*a* and said opposed second end 314*b'* are respectively positioned on opposite sides of the first resilient vertical member 312' of resilient tightening member 306'.

In the embodiment shown in FIG. 4*a*, first resilient vertical member 312' of resilient tightening member 306' may be affixed to fitted sheet 300 by an overlock-stitch stitching 308' (or alternatively by any other stitching pattern, including any of a single-stitch stitching pattern or a double-stitch stitching pattern), whereas second resilient horizontal member 314' of resilient tightening member 306 may be affixed to fitted sheet 300 by double-stitch stitching 320*a*, 320*b'* (or alternatively by any other stitching pattern, including any of a single-stitch stitching pattern or an overlock-stitch stitching pattern).

In an embodiment shown in FIG. 4*b*, where the second resilient horizontal member 314' of resilient tightening member 306' is positioned at the opposed second end 312*b'* of the first vertically oriented elastic strip 312, the resilient tightening member 306' has an inverted T-shape or inverted T-configuration.

In any of the above-described configurations for the second horizontally oriented elastic strip 314', said second horizontally oriented elastic strip 314' is configured and positioned on fitted sheet 300 such that when the fitted sheet is fitted onto a mattress, the second horizontally oriented elastic strip 314' is separated from the each of the corresponding top and bottom corners of the mattress.

In an embodiment, the second horizontally oriented elastic strip 314' comprises an elastic strip having 25 mm thickness. In an embodiment, the second horizontally oriented elastic strip 314' has a length of (i) between 203 mm and 560 mm or (ii) between 8 inches and 22 inches.

In another embodiment, the second horizontally oriented elastic strip 314' is affixed to the fitted sheet 300 using a double-stitch stitching pattern.

In Table 2 below, various non-limiting, exemplary extension and force parameters corresponding to exemplary embodiments of the first vertically oriented elastic strip 312' are provided.

| Exemplary Specimen | Extension (%) | Force (N/Newton) |
|---|---|---|
| Specimen # 1 | 100% | 7.21 |
| Specimen # 2 | 200% | 16.78 |
| Specimen # 3 | 225% | 50.83 |

In an embodiment, the second horizontally oriented elastic strip 314' of resilient tightening member 306' is affixed to the fitted sheet 300 at a distance of between 100 mm and 305 mm from the elastic retainer band provided on fitted sheet 300. In another embodiment, the second horizontally oriented elastic strip 314' of resilient tightening member 306' is affixed to the fitted sheet 300 at a distance of between 4 inches and 14 inches from elastic retainer band. In an embodiment of the invention, second horizontally oriented elastic strip 314' of resilient tightening member 306' is separated from the elastic retainer band by a distance of substantially 154.2 mm.

Figure 5:
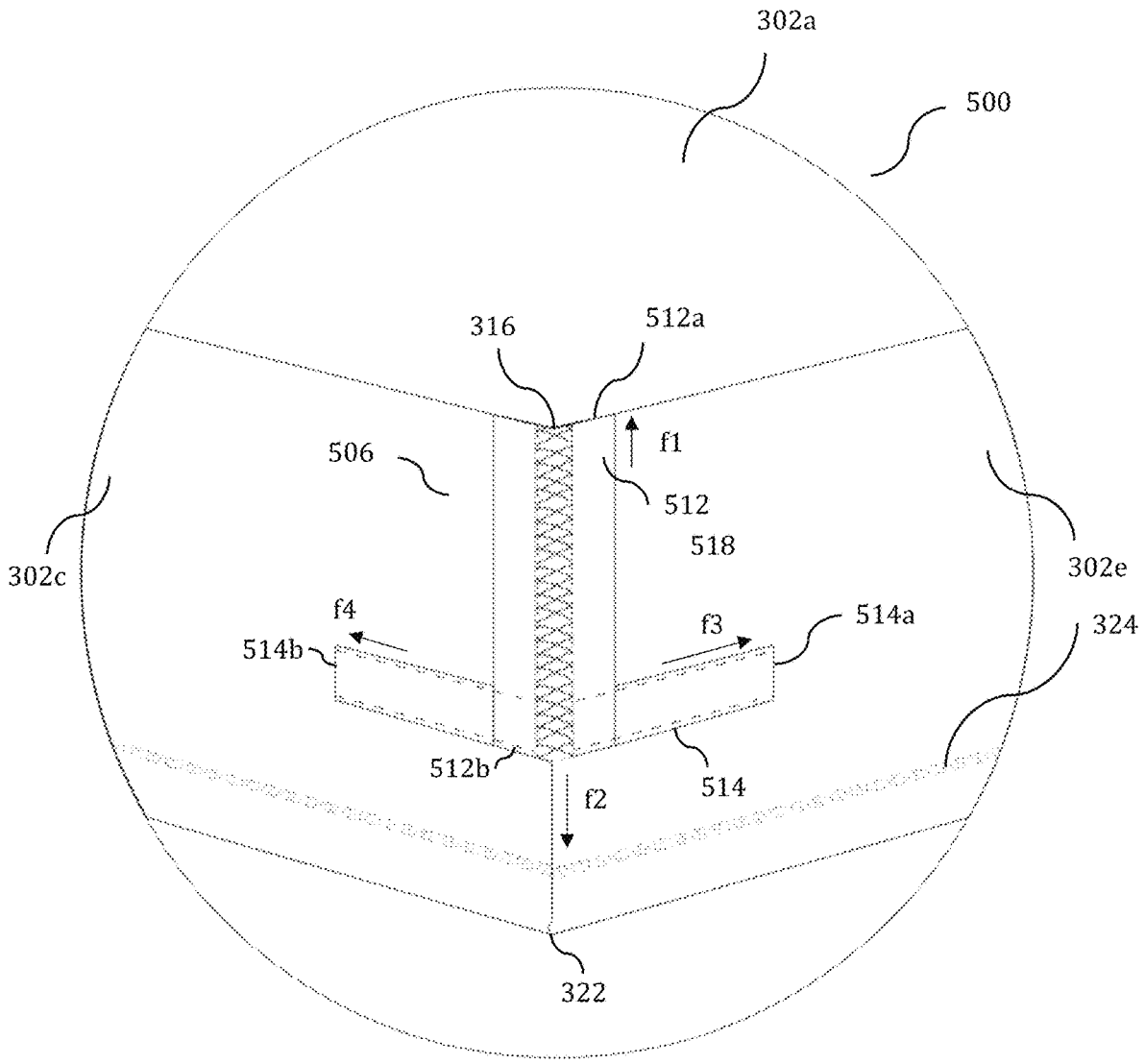
FIG. 5 illustrates the force action of various resilient tightening members provided on or within the fitted sheet of the present invention, for reducing or eliminating bunching and wrinkling of the sheet fabric at corners of the mattress.

FIG. 5 illustrates the force action of various resilient tightening members provided on or within the fitted sheet of the present invention, for reducing or eliminating bunching and wrinkling of the sheet fabric at corners of the mattress.

FIG. 5 shows a magnified view 500 of an embodiment of a resilient tightening member 506 (of a kind which has been described previously in connection with FIGS. 4*a* and 4*b*), that may be used as a resilient tightening member 304, 306, 308, 310 at any one or more junctions of the fitted sheet.

As shown in magnified view 500, resilient tightening member 506 comprises a resilient vertical member 512 (having opposed first and second ends 512*a*, 512*b*) and a resilient horizontal member 514 (having opposed first and second ends 514*a*, 514*b*) of the kind previously illustrated and described in connection with FIG. 4*a* and/or FIG. 4*b*.

As shown in FIG. 5, a total force (or resultant force) that is exerted at or is measurable at the junction or intersection of the first resilient vertical member 312 and the second resilient horizontal member 314 of resilient tightening member 306 comprises a sum of a first force vector f1, a second force vector and a third force vector f3—wherein (i) the first force vector f1 comprises a force vector arising from a first elastic force exerted by the first resilient vertical member of resilient tightening member, 306, (ii) the second force vector comprises a force vector arising from a second elastic force exerted by the second resilient horizontal member of resilient tightening member 302, 304, 306 (which in an embodiment may comprise the sub of force vectors f3 and f4 shown in FIG. 5), and (iii) the third force vector comprises a perpendicular component of a tangential force exerted by elastic retainer band 324 at a point closest to the intersection of the first resilient vertical member 512 and the second resilient horizontal member 514 of resilient tightening member 506. In an embodiment, the total force (or resultant force) that is exerted at or is measurable at the junction or intersection of the first resilient vertical member 512 and the second resilient horizontal member of 514 resilient tightening member 506 is between 3.2 N (Newton) and 4 N (Newton). In an embodiment, the total force (or resultant force) that is exerted at or is measurable at the junction or intersection of the first resilient vertical member 512 and the second resilient horizontal member 514 of resilient tightening member 506 is substantially 3.32 N (Newton).

In an embodiment, the fitted sheet 300 is configured to provide a drop of between 200 mm and 510 mm when encasing a mattress. In an embodiment, the fitted sheet 300 is configured to provide a drop of between 8 inches and 20 inches when encasing a mattress.

In a more specific embodiment of the above, a force that is exerted at or is measurable at a top corner 316 of the fitted sheet 300 with a 406.4 mm (16 inch) drop, as a result of the action of resilient tightening member 506 is between 1.8 N (Newton) and 2.5 (Newton)—and in a preferred embodiment is 2.16 N (Newton).

As a result of the specific configuration of the resilient tightening member 304, 306, 308, 310 as described hereinabove, different magnitudes of force are respectively applied at the top corner of the fitted sheet and at the junction or intersection of the first resilient vertical member and the second resilient horizontal member of resilient tightening member 304, 306, 308, 310—when the fitted sheet is fitted onto a mattress. This creates an unbalanced force at the junction of the two adjoining side panel portions at which said resilient tightening member 304, 306, 308, 310—across the vertical thickness of junction. This unbalanced force enables the sheet to accommodate variations in mattress thicknesses without resulting in excessive slack and, as a consequence, the fitted sheet remains snugly fitted with fewer or no wrinkles at the corner(s) where the resilient tightening member 304, 306, 308, 310 is affixed.

In an embodiment of the invention described above, the invention comprises a fitted sheet configured for encasing a mattress, comprising (i) a top panel portion and a plurality of side panel portions, the top panel portion and the plurality of side panel portions defining an encasement sized to encase a mattress body—wherein each of the plurality of side panel portions includes a respective side panel portion bottom surface that is configured to conform to a bottom surface of an encased mattress body, wherein each of the side panel portion bottom surfaces is resiliently urged towards the other side panel bottom portion bottom surface(s) by an elastic retainer band that is affixed to each of the side panel portion bottom surfaces at or adjacent to a corresponding periphery of said side panel portion bottom surface, and (ii) a resilient tightening member affixed at each junction of the top panel portion and two adjoining side panel portions, wherein (a) the resilient tightening member comprises a first resilient vertical member and a second resilient horizontal member that intersect each other, (b) the first resilient vertical member comprises a first end and an opposed second end, wherein the first end is position at the junction of the top panel portion and the two adjacent side panel portions, and the opposed second end is separated from corresponding side panel bottom surfaces of the conforming parts of two adjacent side panel portions, and (c) the second resilient horizontal member is positioned at a point along a line between the first end and the opposed second end of the resilient vertical member, and comprises two ends, each positioned on opposite sides of the first resilient vertical member.

Further, in this embodiment, a sum of a first force vector, a second force vector and a third force vector exerted at an intersection of the first resilient vertical member and the second resilient horizontal member is between 3.2 N (Newton) and 4 N and (i) the first force vector comprises a force vector arising from a first elastic force exerted by the first resilient vertical member, (ii) the second force vector comprises a force vector arising from a second elastic force exerted by the second resilient horizontal member, and (iii) the third force vector comprises a force vector arising from a perpendicular component of a tangential force exerted by the elastic retainer band 204 at a point closest to the intersection of the first resilient vertical member and the second resilient horizontal member.

In a further embodiment of the fitted sheet the sum of the first force vector, the second force vector and the third force vector is 3.32 N.

In an embodiment, the fitted sheet is configured to provide a drop of between 200 mm and 510 mm.

In another embodiment of the fitted sheet, a force that is exerted by the resilient vertical member at the junction of the top panel portion and the two adjoining side panel portions is between 1.5N and 3N.

In a more specific embodiment of the fitted sheet, the force that is exerted by the resilient vertical member at the junction of the top panel portion and the two adjoining side panel portions is between 1.8 N and 2.5 N.

In another embodiment of the fitted sheet, the force that is exerted by the resilient vertical member at the junction of the top panel portion and the two adjoining side panel portions is 2.16 N.

In a particular embodiment of the fitted sheet, said fitted sheet is configured to provide a drop of between 380 mm and 430 mm—and even more preferably, a drop of 406.4 mm.

In an embodiment of the fitted sheet, the elastic retainer band is an elastic strip having 25 mm thickness.

In an embodiment of the fitted sheet, the first vertically oriented elastic strip comprises an elastic strip having between 10 mm and 14 mm thickness.

In an embodiment of the fitted sheet, the first vertically oriented elastic strip has between 1:1.3 and 1:3.5 elongation.

In another embodiment of the fitted sheet, the first vertically oriented elastic strip has between 1:1.5 and 1:3 elongation.

In a particular embodiment of the fitted sheet, the second horizontally oriented elastic strip comprises an elastic strip having 25 mm thickness.

In an embodiment of the fitted sheet, the second horizontally oriented elastic strip comprises an elastic strip having a length of between 200 mm and 600 mm.

In an embodiment of the fitted sheet, the second horizontally oriented elastic strip comprises an elastic strip having a length of between 203 mm and 560 mm.

In a specific embodiment of the fitted sheet, the second horizontally oriented elastic strip is separated from the elastic retainer band by a distance of between 150 mm and 160 mm—and even more preferably by a distance of 154.2 mm.

It will be understood that the present invention is capable of being applied to fitted sheets and resilient tightening members that are made of any material, including without limitation any of cotton, hemp, polyblend etc., and likewise may comprise fabric of any weave, including without limitation, any of satin, percale, twill etc.

While the exemplary embodiments of the present invention are described and illustrated herein, it will be appreciated that they are merely illustrative. It will be understood by those skilled in the art that various modifications in form and detail may be made therein without departing from or offending the scope of the invention as defined by the appended claims. Additionally, the invention illustratively disclose herein suitably may be practiced in the absence of any element which is not specifically disclosed herein—and in a particular embodiment that is specifically contemplated, the invention is intended to be practiced in the absence of any one or more element which are not specifically disclosed herein.

What is claimed is:

1. A fitted sheet configured for encasing a mattress comprising:

a top panel portion; and a plurality of side panel portions, the top panel portion and the plurality of side panel portions defining an encasement sized to encase a mattress body;

wherein each of the plurality of side panel portions comprises a respective side panel portion bottom surface that is configured to conform to a bottom surface of an encased mattress body, wherein each of the side panel portion bottom surfaces is resiliently urged towards the other side panel bottom portion bottom surface(s) by an elastic retainer band that is affixed to each of the side panel portion bottom surfaces at or adjacent to a corresponding periphery of said side panel portion bottom surface, and a resilient tightening member affixed at each junction of the top panel portion and two adjoining side panel portions, wherein the resilient tightening member comprises a first resilient vertical member and a second resilient horizontal member that intersect each other, wherein the first resilient vertical member comprises a first end and an opposed second end, wherein the first end is position at the junction of the top panel portion and the two adjacent side panel portions, and the opposed second end is separated from corresponding side panel bottom surfaces of the conforming parts of two adjacent side panel portions, wherein the second resilient horizontal member is positioned at a point along a line between the first end and the opposed second end of the resilient vertical member, and comprises two ends, each positioned on opposite sides of the first resilient vertical member, wherein a sum of a first force vector, a second force vector and a third force vector exerted at an intersection of the first resilient vertical member and the second resilient horizontal member is between 3.2 N (Newton) and 4 N, and wherein the first force vector comprises a force vector arising from a first elastic force exerted by the first resilient vertical member, the second force vector comprises a force vector arising from a second elastic force exerted by the second resilient horizontal member, and the third force vector comprises a force vector arising from a perpendicular component of a tangential force exerted by the elastic retainer band at a point closest to the intersection of the first resilient vertical member and the second resilient horizontal member.

2. The fitted sheet according to claim 1, wherein the sum of the first force vector, the second force vector and the third force vector is 3.32 N.

3. The fitted sheet according to claim 1, wherein the fitted sheet is configured to provide a drop of between 200 mm and 510 mm.

4. The fitted sheet according to claim 1, wherein a force that is exerted by the resilient vertical member at the junction of the top panel portion and the two adjoining side panel portions is between 1.5 N and 3 N.

5. The fitted sheet according to claim 4, wherein the force that is exerted by the resilient vertical member at the junction of the top panel portion and the two adjoining side panel portions is between 1.8 N and 2.5 N.

6. The fitted sheet according to claim 5, wherein the fitted sheet is configured to provide a drop of between 380 mm and 430 mm.

7. The fitted sheet according to claim 6, wherein the fitted sheet is configured to provide a drop of 406.4 mm.

8. The fitted sheet according to claim 4, wherein the force that is exerted by the resilient vertical member at the junction of the top panel portion and the two adjoining side panel portions is 2.16 N.

9. The fitted sheet according to claim 1, wherein the elastic retainer band is an elastic strip having 25 mm thickness.

10. The fitted sheet according to claim 1, wherein the first vertically oriented elastic strip comprises an elastic strip having between 10 mm and 14 mm thickness.

11. The fitted sheet according to claim 10, wherein the first vertically oriented elastic strip has between 1:1.3 and 1:3.5 elongation.

12. The fitted sheet according to claim 11, wherein the first vertically oriented elastic strip has between 1:1.5 and 1:3 elongation.

13. The fitted sheet according to claim 1, wherein the second horizontally oriented elastic strip comprises an elastic strip having 25 mm thickness.

14. The fitted sheet according to claim 1, wherein the second horizontally oriented elastic strip comprises an elastic strip having a length of between 200 mm and 600 mm.

15. The fitted sheet according to claim 14, wherein the second horizontally oriented elastic strip comprises an elastic strip having a length of between 203 mm and 560 mm.

16. The fitted sheet according to claim 1, wherein the second horizontally oriented elastic strip is separated from the elastic retainer band by a distance of between 150 mm and 160 mm.

17. The fitted sheet according to claim 16, wherein the second horizontally oriented elastic strip is separated from the elastic retainer band by a distance of 154.2 mm.

* * * * *